US006167115A

United States Patent [19]

Inoue

[11] Patent Number: 6,167,115

[45] **Date of Patent: *Dec. 26, 2000**

[54] RADIATION IMAGE PICKUP APPARATUS AND DRIVING METHOD THEREFOR

[75] Inventor: Hitoshi Inoue, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/034,449

[22] Filed: Mar. 4, 1998

[30] Foreign Application Priority Data

Mar. 6, 1997 [JP] Japan ..... 9-051700
Feb. 26, 1998 [JP] Japan ..... 10-045079

[51] Int. Cl.[7] ..... G21K 1/00

[52] U.S. Cl. ..... 378/155; 378/154

[58] Field of Search ..... 378/154, 155, 378/96, 97, 108

[56] References Cited

U.S. PATENT DOCUMENTS

| | | | |
|---|---|---|---|
| 4,382,184 | 5/1983 | Wernikoff | 378/37 |
| 4,803,716 | 2/1989 | Ammann et al. | 378/155 |
| 4,829,552 | 5/1989 | Rossi et al. | 378/154 |
| 5,379,335 | 1/1995 | Griesmer et al. | 378/155 |
| 5,666,395 | 9/1997 | Tsukamoto et al. | 378/98.4 |

*Primary Examiner*—David V. Bruce
*Assistant Examiner*—Pamela R. Hobden
*Attorney, Agent, or Firm*—Fitzpatrick, Cella, Harper & Scinto

[57] ABSTRACT

By providing a movable grid for eliminating the scattered component of radiation entering a radiation image pickup unit and a controller for controlling the moving speed of the movable grid corresponding to variation of the intensity of the radiation, the grid can be controlled based on a predetermined radiation irradiating time.

54 Claims, 9 Drawing Sheets

RADIATION IMAGE PICKUP APPARATUS AND DRIVING METHOD THEREFOR

BACKGROUND OF THE INVENTION

1. Field of the Invention

The present invention relates to a radiation image pickup apparatus including an X-ray image pickup apparatus, and a method of driving the apparatus, and more particularly to a radiation image pickup apparatus for forming an image representing the intensity distribution of radiation such as X-ray, and a method of the apparatus.

2. Related Background Art

In case of forming an image representing the distribution of a radiation such as X-ray transmitted by an inspected object for example in a non-destructive inspection, there may only be obtained a blurred image about the interior of the object, since such image not only represents the linearly transmitted component but also the scattered components, generated in the inspected object transmitting the X-ray. In the medical diagnostic field, there has long been adopted a method of providing a so-called grid, consisting of a plurality of lead plates arranged in a mutually spaced and parallel manner, thereby guiding the straight proceeding component only to a fluorescent plate or the image pickup apparatus for converting the X-ray distribution into the image.

Such grid is generally formed by arranging lead plates into a one-dimensional grating, so that the obtained image bears a striped pattern corresponding to such grating.

Such grating pattern tends to be very conspicuous in the image in case the image is recorded for example on a film. Also such grid, effecting spatial multiplication, shows an effect of modulating the image itself with the frequency of the grid, so that components finer than the frequency of the grid tend to be lost if the grid is present. Also there is recently developed an apparatus capable of directly acquiring the distribution of X-ray with an image pickup apparatus and converting such distribution into a digital image by sampling, and, in such apparatus, the grid image is modulated by the sampling carrier whereby stripes of a frequency different from the grid frequency becomes conspicuous. (This phenomenon may be understood as an aliasing of the spatial spectrum of the grip by the sampling.)

For preventing such phenomena, there have been proposed various methods of moving the grid in a direction perpendicular to the stripes thereof during the X-ray irradiation, thereby reducing the contrast of the grid and extinguishing the stripes.

In the following there will be considered the mode of contrast reduction of the grid stripes by such movement. It is assumed that the grid is limited to a one-dimensional structure and the spectrum is considered in a direction perpendicular to the grid stripes. If the spectrum of the grid is represented by a function G(f) (wherein f is spatial frequency) and the OTF (optical transfer function) of the film, the fluorescent plate which converts the intensity of X-ray into the intensity of fluorescent light or the image pickup apparatus is represented by a function H(f), the spectrum L(f) of the grid which is finally obtained through the fluorescent plate, etc. is represented by the following equation (1):

$$L(f)=G(f)\times H(f) \tag{1}$$

As the grid can be represented by a periodic function, if the grid pitch is $T_g$, G(f) can be represented, utilizing Fourrier series development by a group of linear spectra. Since H(f) is a linear filtering mechanism, H(f) can also be represented by a group of linear spectra, and is represented by the following equation (2):

$$L(f)=\sum_{n=-\infty}^{n=+\infty}(a_n\delta(f-n/T_g)+jb_n\delta(f-n/T_g)) \tag{2}$$

wherein δ(f) is the Dillac's delta function, $a_n=a_{-n}$ and $b_n=-b_{-n}$ (n being an integer).

The contrast when the grid is stopped can be obtained by determining the spatial contrast through inverse Fourrier conversion of the above equation (2).

If a grid with a spatial pitch Tg of the stripes moves at a constant speed in a direction perpendicular to the stripes, the spatial shape s(x) under the X-ray irradiation of a predetermined amount for a period of movement of m stripes over a point is represented by the following equation (3):

$$s(x)=\int_0^{mTg'} l(x-x')dx' \tag{3}$$

wherein the inverse Fourrier conversion of L(f), namely a shape in a real space is regarded as l(x).

As the frequency characteristics S(f) of s(x) is the product of L(f) and the frequency characteristics of a rectangle of distance $mT_g$, namely sinc function, it can be represented by the following the equation (4):

$$|S(f)|\ |L(f)|\times\sin(\pi mfT_g)/(\pi mfT_g) \tag{4}$$

wherein the frequency characteristics represent only the amplitude since the phase is disregarded.

From the equations (2) and (4), it will be understood that, when m is a non-zero integer, the line spectrum component of L(f) overlaps with the zero point of sinc function, whereby |S(f)| becomes the DC component alone and the stripes of the grid are completely extinguished.

The sinc function ($\sin\pi mfT_g/\pi mfT_g$) in the equation (4) always becomes zero (zero point) at $f=k/(mT_g)$ wherein k is a non-zero integer. The equation (2) has only a value at $f=n/T_g$ wherein n is an integer, so that, in the product of the both, when m is a non-zero integer in |S(f)|, the zero point of sinc function coincides with a non-zero f value of the equation (2) to cancel components with f being other than 0. Consequently there is only left the DC component.

FIG. 1 is a graph showing the spatial contrast of the grid image after passing the fluorescent plate in the ordinate, as a function of the number of moving stripes of the grid during the irradiation time in the equation (4) in the abscissa, calculated by the OTF of the fluorescent plate. It is represented in decibels, taking the contrast of the grid itself as reference. As shown in this graph, the entire contrast becomes lower with an increase in the moving distance, and, in the illustrated example, the contrast becomes −40 dB (1/100) or lower with the passing of 11 or more stripes and is therefore in the practically acceptable level. However, since the movement is conducted mechanically, it is very difficult to always move 10 or more stripes in any X-ray irradiation time, and a powerful driving system has to be provided for this purpose. For this reason, it is desired to reduce the contrast of the grid even with the movement of a short distance. In FIG. 1, for example a moving distance in a range A shows a contrast of −40 dB or less even with a moving distance of about 5 stripes. Such range always exists in the vicinity of any non-zero integral value of m.

Consequently, the grid contrast can be significantly reduced even with a short distance, by moving the grid by an integral number of stripes corresponding to the X-ray irradiation time.

In order to obtain an X-ray image of high quality in the field of medical diagnosis or non-destructive inspection, since the required amount of X-ray varies depending on the fluctuation of an inspected object such as the human body (for example, body size or inspected region), the optimum X-ray dose (irradiation time) is determined utilizing a device called a phototimer, which measures the amount of X-ray transmitted by the inspected object such as the human body. In such case there is generally employed a method of monitoring the accumulated amount of the X-ray transmitted by the inspected object such as the human body and stopping the X-ray irradiation when a predetermined dose is reached.

Consequently the X-ray irradiation time varies depending on the inspected person, the inspected region or the kind of the inspected object. Therefore, even if the aforementioned grid movement in the range A in FIG. 1 is carried out, such movement cannot be controlled since the irradiation time cannot be known in advance.

Also the X-ray irradiation may not be constant in time, for example due to the influence of fluctuation of the power supply. In such case, the graph shown in FIG. 1 cannot be applied, and it becomes difficult to control and completely extinguish the grid image.

For forming an image representing the distribution of X-ray radiation, the distribution of radiation is converted with a fluorescent plate into an optical intensity distribution, which is recorded as a latent image on a silver salt film and developed, but in recent years there is also proposed a method of converting such optical intensity distribution with an image pickup device into electrical signals, which is then converted into digital data and formed into a digital image. In this method there is also known a system of directly converting the distribution of X-ray radiation directly into electrical signals without employing the fluorescent plate. The aforementioned difficulty with the stripe pattern also occurs in these cases.

In such case, in order to convert the continuous distribution of X-ray radiation, transmitted by the inspected object, into a discrete distribution, there is required spatial sampling in a matrix pattern with a predetermined pitch.

Since such spatial sampling naturally acquires the above-mentioned grid image at the same time, there is in this case generated a drawback of pseudo resolution of the grid image.

More specifically, based on the basic sampling principle, in case the grid having the spectral characteristics L(f) represented by the equation (2) is sampled with a sampling pitch Ts (multiplication of a train of Dillac's delta functions with a pitch $T_s$), the sampled spectrum L'(f) can be obtained by the convolution calculation with the spectral characteristics of the sampling function, i.e., by the following equation (5):

$$L'(f) = \sum_{k=-\infty}^{\infty} L(f - k/Ts) \tag{5}$$

Stated differently, even in case of considering only the basic pitch $T_g$ of the grid, the grid spectral frequency by aliasing appears at positions $|1/T_s \pm 1/T_g|$. As an example, if $1/T_g > 1/(2T_s)$, the grid pattern appears at the Nyquist frequency of sampling or lower to generate a low-frequency image, which is mixed with the original image spectrum and cannot be separated therefrom, resulting in a seriously defective image.

Even if the grid is moved to reduce the contrast as mentioned above, the influence of the grid cannot be eliminated completely since the spectral position remains unchanged.

Also in case the sampling frequency is so selected as to prevent the aliasing of the basic pitch, such as $1/T_g < 1/(2T_s)$, the influence of the high frequency components is also strong and the grid stripes cannot be sampled in a stable manner, so that the low-frequency pseudo resolution tends to appear with a high probability.

SUMMARY OF THE INVENTION

An object of the present invention is to provide a radiation image pickup apparatus capable of satisfactorily eliminating the grid stripe pattern, and a method of driving the apparatus.

Another object of the present invention is to provide a radiation image pickup apparatus capable of satisfactorily eliminating the grid stripe pattern irrespective of the kind or region of the inspected object, and a method of driving the apparatus.

Still another object of the present invention is to provide a radiation image pickup apparatus capable of satisfactorily eliminating the grid stripe pattern irrespective of the fluctuation in the radiation intensity distribution, and a method of driving the apparatus.

Still another object of the present invention is to provide a radiation image pickup apparatus comprising a movable grid for eliminating scattered components of the radiation entering the radiation image pickup means, and means for controlling the moving speed of the movable grid in correspondence with the intensity variation of the radiation.

Still another object of the present invention is to provide a method of driving a radiation image pickup apparatus capable of controlling the moving speed of a grid corresponding to the variation in the intensity of the radiation so as to eliminate the scattered component of the incident radiation entering the radiation image pickup means.

The above-mentioned objects can be attained on basis of the finding that the radiation image pickup apparatus of the present invention comprises a movable grid for eliminating the scattered component of the incident radiation entering the radiation image pickup means and means for controlling the moving speed of the movable grid corresponding to the intensity variation of the radiation.

More specifically, according to the present invention, the performance of the movable grid can be made independent of the irradiation time or the characteristics in time of the irradiation, by employing an integrated output of a radiation dose monitor and moving the grid under position control to a position according to the output of such radiation dose monitor, namely correlating the moving speed of the grid with the variation in the radiation dose.

The radiation dose monitor is advantageously composed of a phototimer which converts the incident radiation into light detectable with a photoelectric converting device and effecting photoelectric conversion of such light by a photoelectric converting device. Naturally the phototimer may be composed of an element that directly converts the radiation into electrical signals.

Stated differently, the above-mentioned objects can be attained, according to the present invention, by realizing a movable grid of which performance is independent from the irradiation time or the characteristics in time of the irradiation, by employing the integrated output of an X-ray dose monitor (phototimer) and moving the grid under position control to a position corresponding to the output, namely correlating the moving speed of the grid with the variation in the radiation dose (for example, in proportion thereto).

In case of image acquisition with an image pickup panel having a plurality of image reading pixels, it is preferable to acquire, with the movable grid, the spatial distribution without the object in advance, thereby obtaining as the fluctuation in gain of each pixel of the image pickup panel, as the shading characteristics of the X-ray radiation.

It is also preferable, at a timing when the moving speed of the grid is correlated with the controllable condition, to effect timing control for the drive of the image pickup panel and the X-ray irradiation.

It is also preferable, in order to correct the offset value of the image pickup panel, to acquire the output signal, namely the offset value, from the image pickup panel in the absence of X-ray irradiation immediately before or after the X-ray irradiation, and to subtract such offset value from the obtained image data.

It is also possible to significantly reduce the stripe pattern resulting from the grid, even for a constant pixel pitch of the image pickup panel, by setting the apertures therein at a suitable size matching the size of the grid or by setting the pitch of the grid, matching the size of the apertures.

DETAILED DESCRIPTION OF THE PREFERRED EMBODIMENTS

Figure 1:
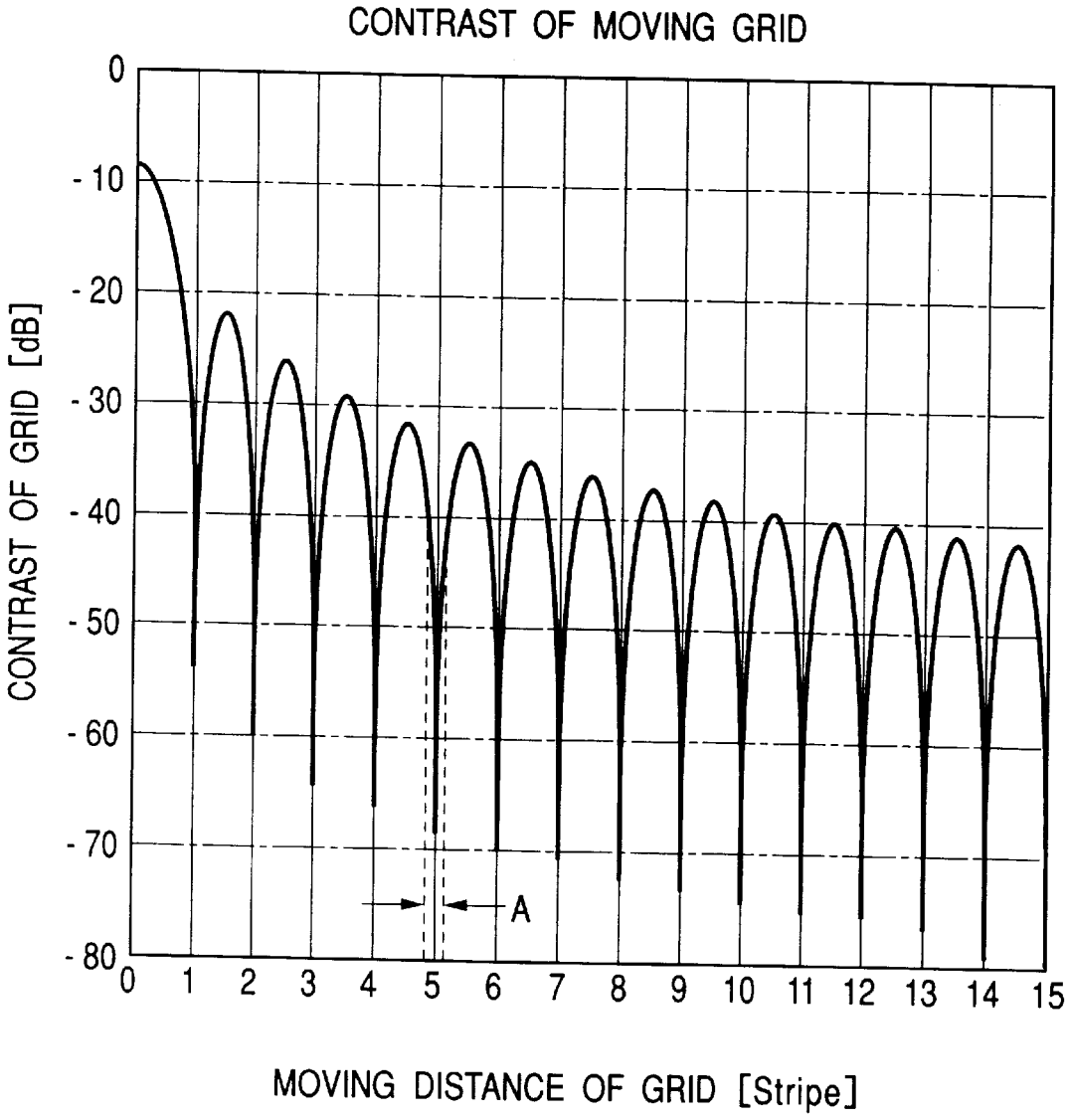
FIG. 1 is a graph showing the calculated contrast of the grid image as a function of the moving distance of the grid in the absence of variation in the X-ray intensity.

At first there will be explained the principle of elimination of the stripe pattern resulting from the grid.

As explained in the foregoing, it is assumed that the grid has a spatial pattern l(x) (x being spatial position) after conversion by a wavelength converting member such as a fluorescent plate and that such grid pattern moves with a velocity v(t) (t indicating time) variable in time. Also the X-ray dose is represented by a time-dependent function q(t).

The exposure amount s(x, T) of X-ray at a position x on a film or on an image pickup element including photoelectric converting elements in a time period T is represented by the following time integration, i.e., the equation (6):

$$s(x, T) = \int_0^T l\left(x - \int_0^t v(t)dt\right)q(t)dt \tag{6}$$

Now the velocity v(t) is varied in proportion to the X-ray dose q(t), as indicated by the following equation (7):

$$q(t)=\mathrm{K}v(t) \tag{7}$$

wherein K is a proportion coefficient.

By substituting the equation (7) into the equation (6) there can be obtained by the following equation (8):

$$s(x, T) = K\int_0^T l\left(x - \int_0^t v(t)dt\right)v(t)dt \tag{8}$$

wherein the following equation (9):

$$\int_0^t v(t)dt \tag{9}$$

indicates the moving distance for time t. By taking this moving distance as x', there can be achieved a variable conversion v(t)=dx'/dt whereby the equation (8) can be rewritten as the following equations (10) and (11):

$$s(x, T) = K\int_0^Y l(x - x')dx, \tag{10}$$

$$Y = \int_0^T v(t)dt \tag{11}$$

It will be understood that the equation (10) has the same form as the equation (3). Therefore, the variation of the X-ray dose can be canceled by controlling the moving speed of the grid in proportion to the variation of the X-ray dose, and the state of exposure can be handled equivalent to the exposure under a constant radiation dose with a movable grid of a constant speed, whereby the contrast characteristics shown in FIG. 1 become applicable. Consequently, the grid stripes can be satisfactorily eliminated by selecting the moving distance, or Y in the equation (10), close to an integral multiple of the grid pitch.

Even in case the radiation image pickup apparatus has the moving mechanism based on a combination of a motor and a cam which cannot easily achieve the above-mentioned position control of the grid movement, the moving speed of the grid can be controlled within a certain extent by the speed of the motor. Therefore, even if the complete cancellation of the variation of the X-ray dose is impossible, it is possible to reduce the stripe to a certain extent according to the principle of the present invention, by monitoring the radiation dose with the phototimer in the vicinity of the maximum speed of an usually used cam for driving the motor, rapidly effecting speed control of the motor assuming that the initial radiation dose is maintained, and stopping the moving distance of the grid at a substantially integral multiple of the grid pitch at the end of the image acquisition, namely when the radiation dose measured by the phototimer reaches an appropriate dose.

In the following there will be explained the relationship between the aperture of each pixel and the grid pitch, which is a specific feature of the image pickup panel.

Figure 2:
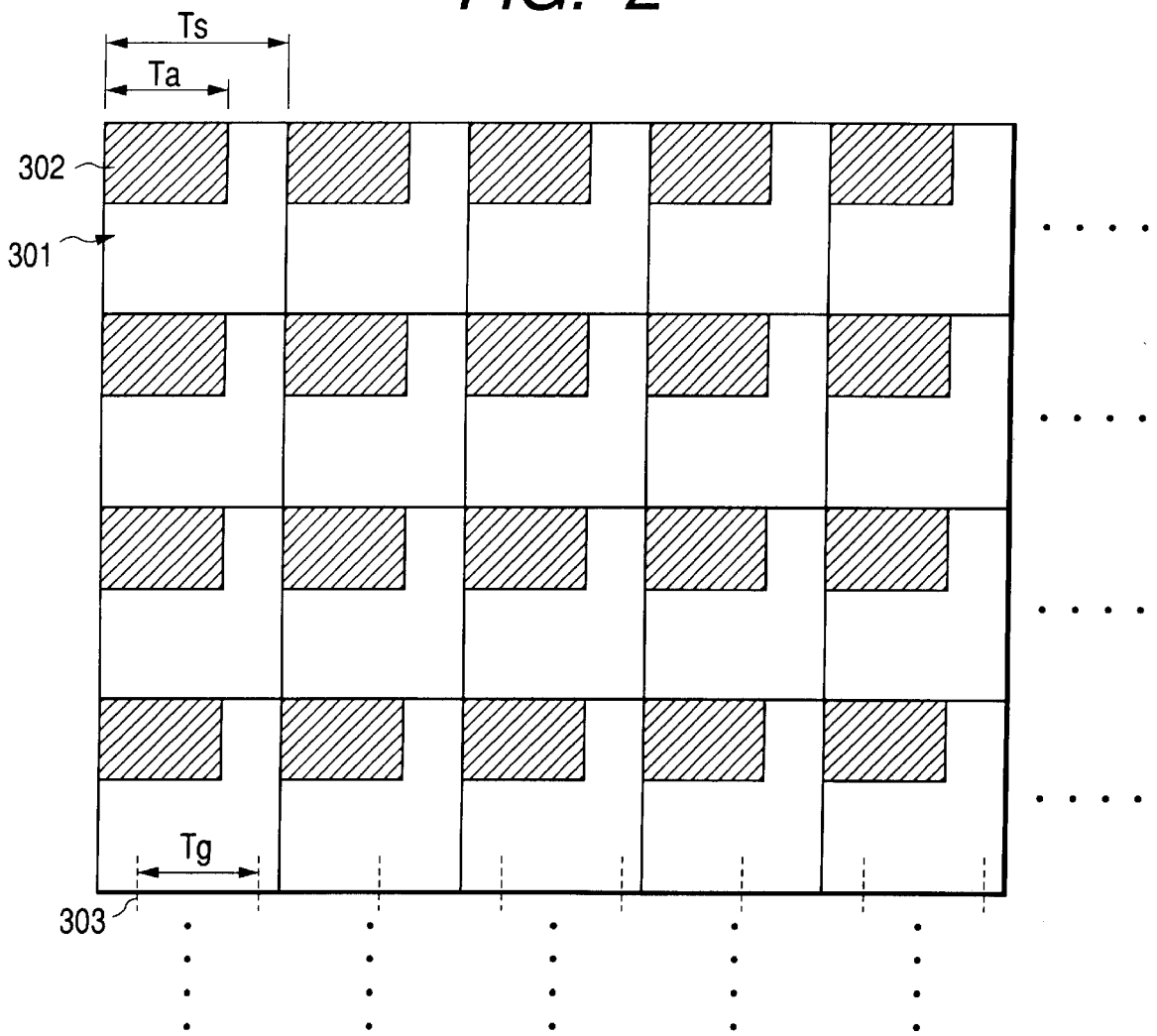
FIG. 2 is a schematic plan view showing an example of the relationship between the pixel pitch and the aperture width.

The sampling with an image pickup panel cannot usually be a sampling based on the ideal Dillac's delta function, but requires apertures for spatially integrating the quantity of light. FIG. 2 shows an example of the physical arrangement of pixels on an image pickup panel, wherein a square 301 indicates one pixel, and a portion 302 indicates a light receiving portion in each pixel pitch and is composed, for example, of a photodiode in case of a solid-state image pickup device. The remaining portion in the pixel serves as peripheral circuits including a wiring for receiving and transmitting the photocurrent from the photodiode.

The size of an aperture within one pixel is regarded as $T_a$, and spatial filtering $F_a(f)$, as indicated in the following the equation (12), dependent on the aperture in the main scanning direction indicated by an arrow, is executed prior to the sampling operation with the sampling pitch $T_s$.

$$F_a(f) = \frac{\sin \pi f T_a}{\pi f T_a} \tag{12}$$

Figure 3:
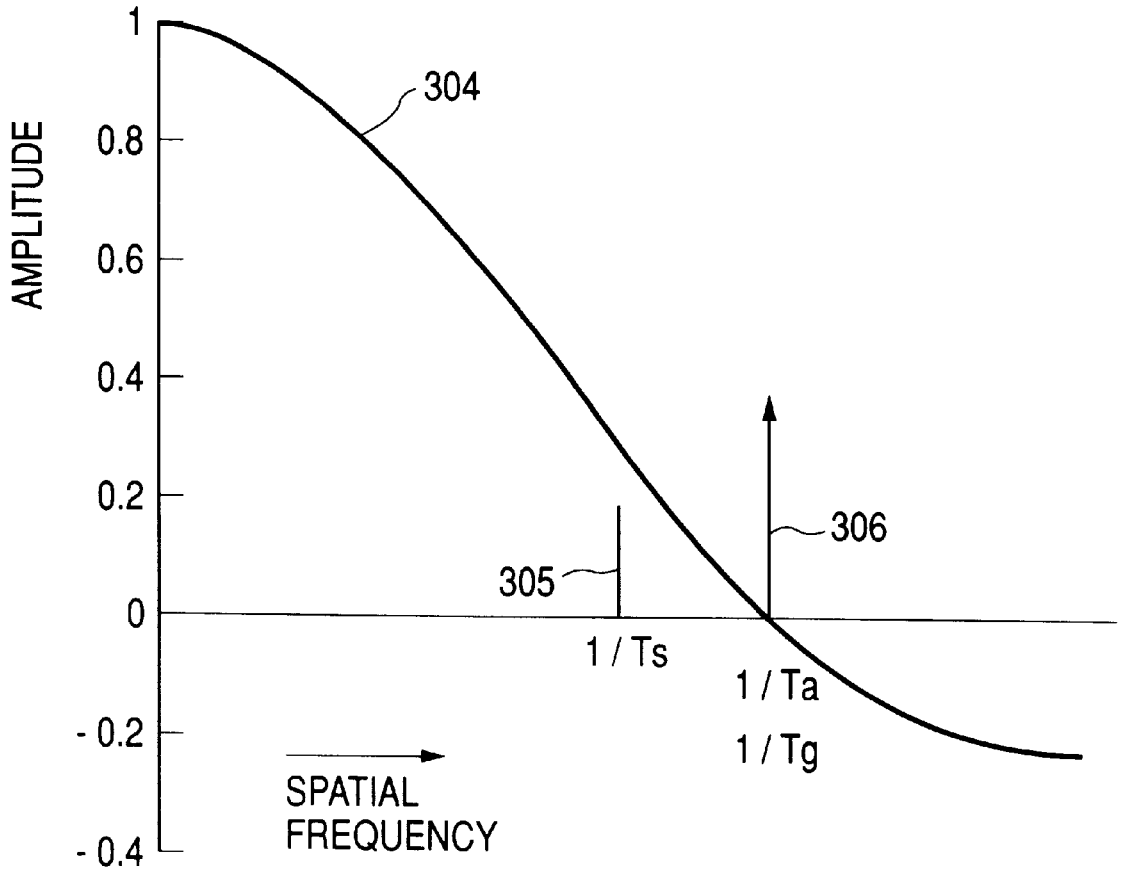
FIG. 3 is a agraph showing an example of the relationship between the transmission function of the aperture and the grid spectrum.

This is known as a sinc function, having a spatial spectrum transmission function indicated by numeral 304 in FIG. 3 and having zero points at $f=n/T_a$ ($n=\pm1, \pm2, \ldots$). Also because of the physical restriction, the aperture size has to be smaller than the sampling pitch, so that $T_s \geqq T_a$. In FIG. 3, numeral 305 indicates a frequency position corresponding to the sampling pitch where so-called sampling carrier exists, and numeral 306 indicates a zero point of the sinc function. The influence of the grid can be reduced by constructing the grid in such a manner that the grid spectrum is positioned in the vicinity of this zero point.

In summary, the influence of the grid can be further reduced by selecting the grid pitch so as not to exceed the sampling pitch and so as to be close to n times (n=1, 2, 3, . . . ) of the width of the aperture.

As an example, if the sampling pitch is 160 $\mu$m and the aperture width in the main scanning direction is (an aperture rate of 78.1% in the main scanning direction), the grid pitch can be selected as 100 $\mu$m (10 lines per 1 mm) irrespective of the sampling pitch. When the shape of the aperture is not a complete rectangle as illustrated in the drawing because of the restriction in the manufacturing process for the image pickup panel, since the special transfer function in the main scanning direction is obtained by the Fourrier conversion of the aperture shape projected in the main scanning direction, the grid is arranged close to the position of minimum amplitude of such special transfer function. However the zero points may not exist in such case, so that complete elimination of the influence of the grid may be unachievable.

Consequently, the influence of grid on the image can be reduced by the movement of the grid or by the selection of the grid pitch as described above.

Now the present invention will be clarified further by embodiments thereof, with reference to the attached drawings.

Embodiment 1

Figure 4:
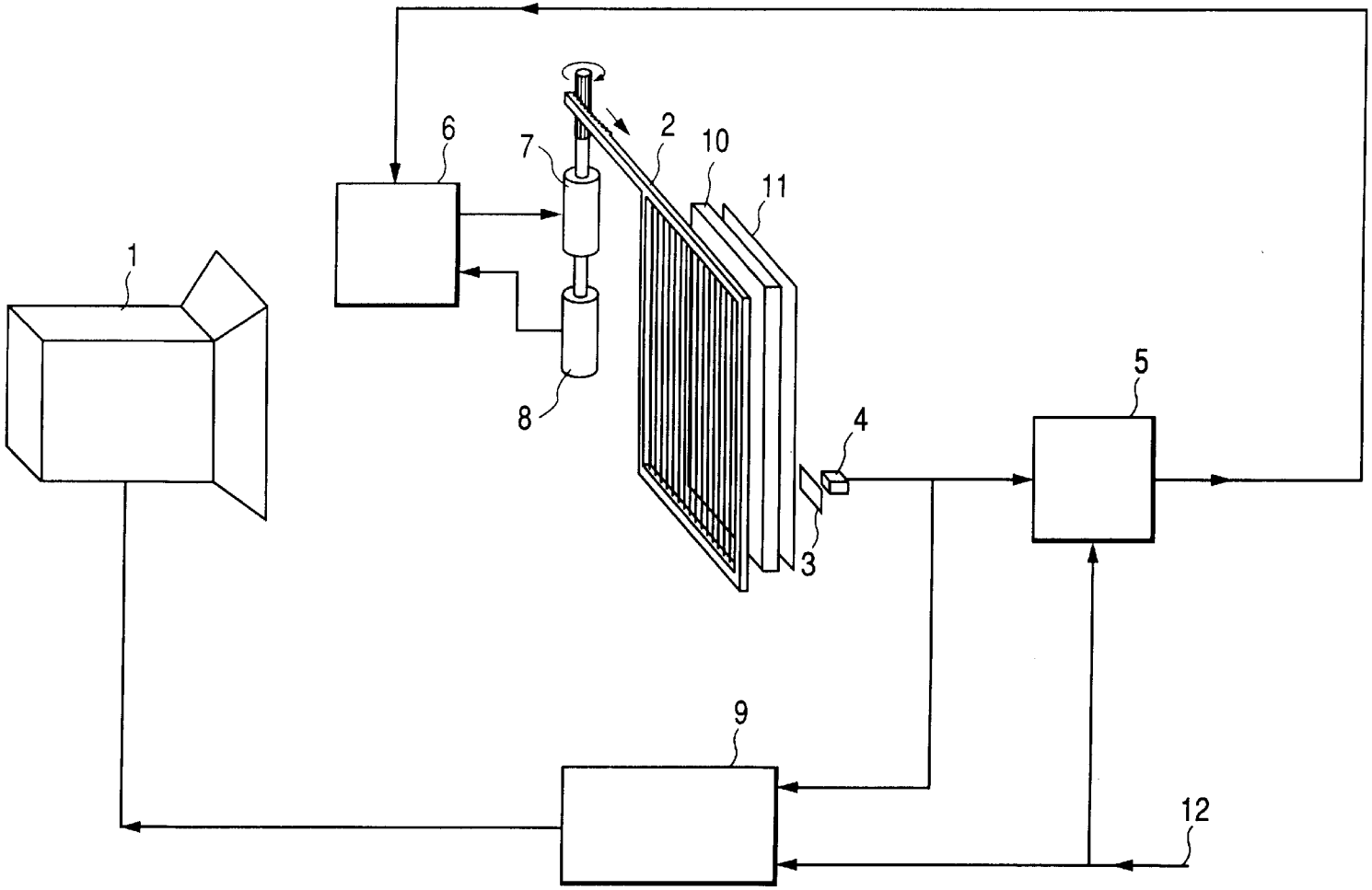
FIGS. 4, 6, 7, 8 and 9 are schematic views showing preferred embodiments of the present invention.

FIG. 4 is a schematic view showing a preferred embodiment of the radiation (X-ray) image pickup apparatus according to the present invention. In FIG. 4, numeral 1 denotes an X-ray generating device 1, numeral 2 denotes a movable grid which is driven by a servo motor 7 and an encoder 8 so as to realize a movement relative to the light receiving surface 11. Numeral 6 denotes a drive control device for the servo motor 7 and the encoder 8, which controls the position of the grid 2 at a position proportional to an input voltage. For example, when a grid pitch is 0.25 mm and an input voltage is 10 V, the device can cause a movement of 1.25 mm corresponding to 5 times of 0.25 mm. Numeral 10 denotes a fluorescent plate for executing wavelength conversion, by converting X-ray into a wavelength detectable by an image pickup device, such as visible light. Numeral 11 denotes a light receiving surface of an image pickup device capable of forming an image of the distribution of the visible light. Numeral 3 denotes a fluorescent member constituting a wavelength converting member for measuring the amount of X-ray transmitted by the above-mentioned components i.e., grid 2, fluorescent plate 10, member constituting the light receiving surface and the like. Numeral 4 denotes a photoelectric converting device for converting the amount of fluorescent light into a voltage and here combination of 3 and 4 is referred to as a phototimer. Numeral 9 denotes a controller for integrating the output of the photoelectric converting device 4 and cutting off the output of the X-ray generating device 1 when the integrated output reaches a predetermined value given by an input 12. Numeral 5 denotes a unit for integrating the output of the photoelectric converting device 4 and amplifying the integrated output with a gain according to the input 12. As an example, the apparatus is so automatically set as to supply the drive control device 6 with a voltage of 10 V when the predetermined value is reached. The fluorescent plate 10, the film or the light receiving surface 11 of the image pickup device and, if necessary, the phototimer (3, 4) constitute radiation image pickup means.

Figure 5A:
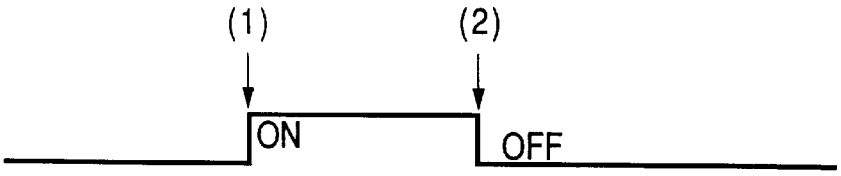
FIG. 5A is a timing chart showing the operation timing of an X-ray cut-off device for controlling the X-ray irradiation.
Figure 5B:
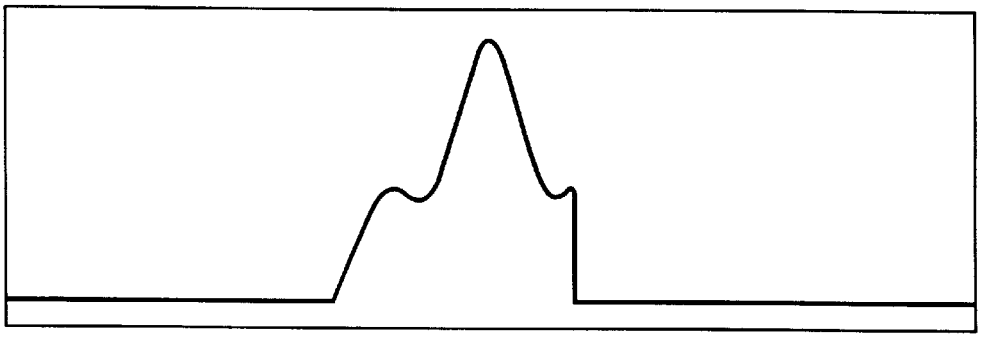
FIG. 5B is timing chart showing an example of the output of a photoelectric converting element.
Figure 5C:
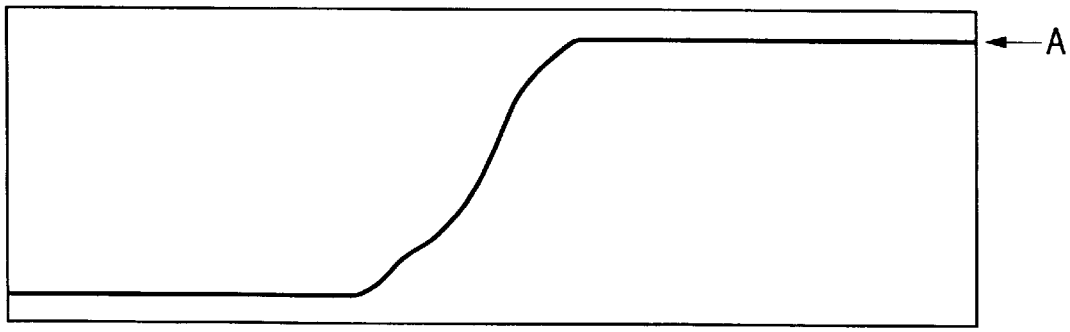
FIG. 5C is a timing chart showing an example of the integrated output of the photoelectric converting element.

The timing charts showing the above state are FIGS. 5A to 5C. FIG. 5A shows the output of the X-ray cut-off control device 9, which initiates the X-ray irradiation at the time (1). FIG. 5B shows the time-dependent characteristics of the X-ray output which is varied as illustrated in the drawing due to the fluctuation of the power supply or the like. FIG. 5C shows the result of integration, for example with calculation means, of the output of the photoelectric converting device obtained from the X-ray shown in FIG. 5B. The X-ray cut-off control device 9 shown in FIG. 4 cuts off the X-ray at the time (2) in FIG. 5A, when a predetermined value A shown in FIG. 5C is reached. A voltage of the same shape as shown in FIG. 5C is supplied by the amplifier 5 shown in FIG. 4 to the servo control device 6, whereby the grid 2 moves under the position control proportional to the characteristics thereof. That is, the moving speed of the grid is proportional to the graph in FIG. 5B, which is the differentiated value of the position control characteristics, and coincides with the time-dependent characteristics of the X-ray output. At the timing when the predetermined value is reached, the moving amount of the grid always corresponds to an integral multiple of the predetermined grid pitch, whereby, as already explained in relation to the foregoing equation (11), the grid pattern on the light receiving surface of the image pickup device becomes constant independently from the time-dependent characteristics of the X-ray output and from the duration of the X-ray output. Also the grid stripe pattern can be satisfactorily reduced since the moving distance of the grid is selected close to an integral multiple of the grid pitch.

Figure 6:
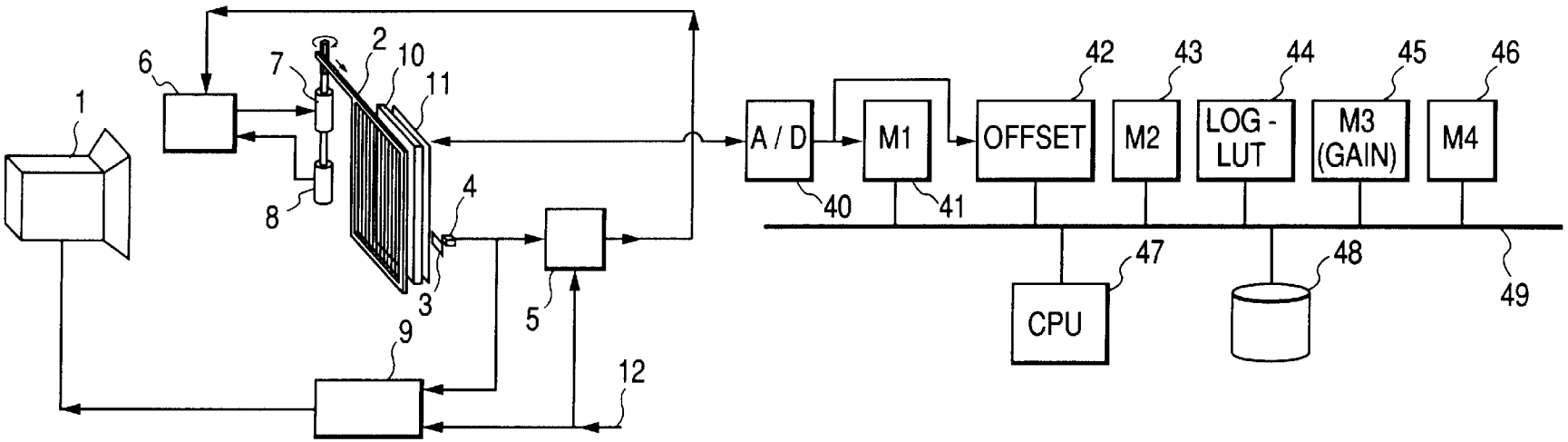

In the following there will be further explained concrete operation utilizing an image pickup device with reference to FIG. 6. In FIG. 6, numeral 40 denotes a control unit for controlling the image pickup device and including an A/D converter for converting the output voltage from the image pickup device constituting the light receiving surface 11 into digital data. Numeral 41 denotes an image memory (M1) for temporarily storing such digital data and connected to a signal bus 49. Numeral 42 denotes an image memory for storing an offset value of the image pickup device. Numeral 43 denotes an image memory 43 (M2) for temporarily storing the image data after the subtraction of the offset value. Numeral 44 denotes a logarithmic conversion look-up table memory (LOG-LUT) for executing a division for the gain correction of the image. Numeral 45 denotes an image memory 45 (M3) for storing the fluctuation of the gain of the image pickup device, acquired in the absence of the object. Numeral 46 denotes a memory (M4) for storing the final image data. Numeral 47 denotes a central processing unit for executing calculations and control. Numeral 48 denotes memory medium such as a floppy disk (FD), a hard disk (HD) or a magnetooptical disk storing control programs (MOD).

At first the image is acquired in the absence of object and with the movement of the grid, and the acquired image is stored through the A/D converter 40 into the memory M1. Before or after this operation, also the image is acquired in the absence of object and without the X-ray irradiation to store it as an offset value in the offset memory 42. Then the data stored in the memory M1 are transferred, with successive subtraction of the values of the respectively corresponding positions in the offset memory, to the memory M2, and then the data therein are converted by the LOG-LUT into logarithmic values to store them in the memory M3.

At the actual image data acquisition, the image pickup device is activated immediately prior to the image data acquisition. Then, in a state of enabling the image data acquisition, the motor is driven for a short distance to eliminate the influence of the starting torque, and when such influence is no longer present, the X-ray irradiation is started. Thus the image acquisition can be achieved by controlling the grid position according to the operation as explained in the foregoing, corresponding to the output of the phototimer 4.

After the X-ray irradiation is cut off, the grid may continue movement by inertia or the like. Also, if the grid requires a higher initial driving force than in the usual movement, the grid movement may be started even before the start of X-ray irradiation.

Also in case the motor speed is proportional to the applied voltage, the motor may be driven directly with the monitored output of X-ray instead of position control with the integrated output.

Although the present embodiment utilizes the output of the phototimer, in place of it there may be utilized the variation of X-ray intensity by using any other means capable of monitoring the variation of the intensity of X-ray.

Embodiment 2

Figure 7:
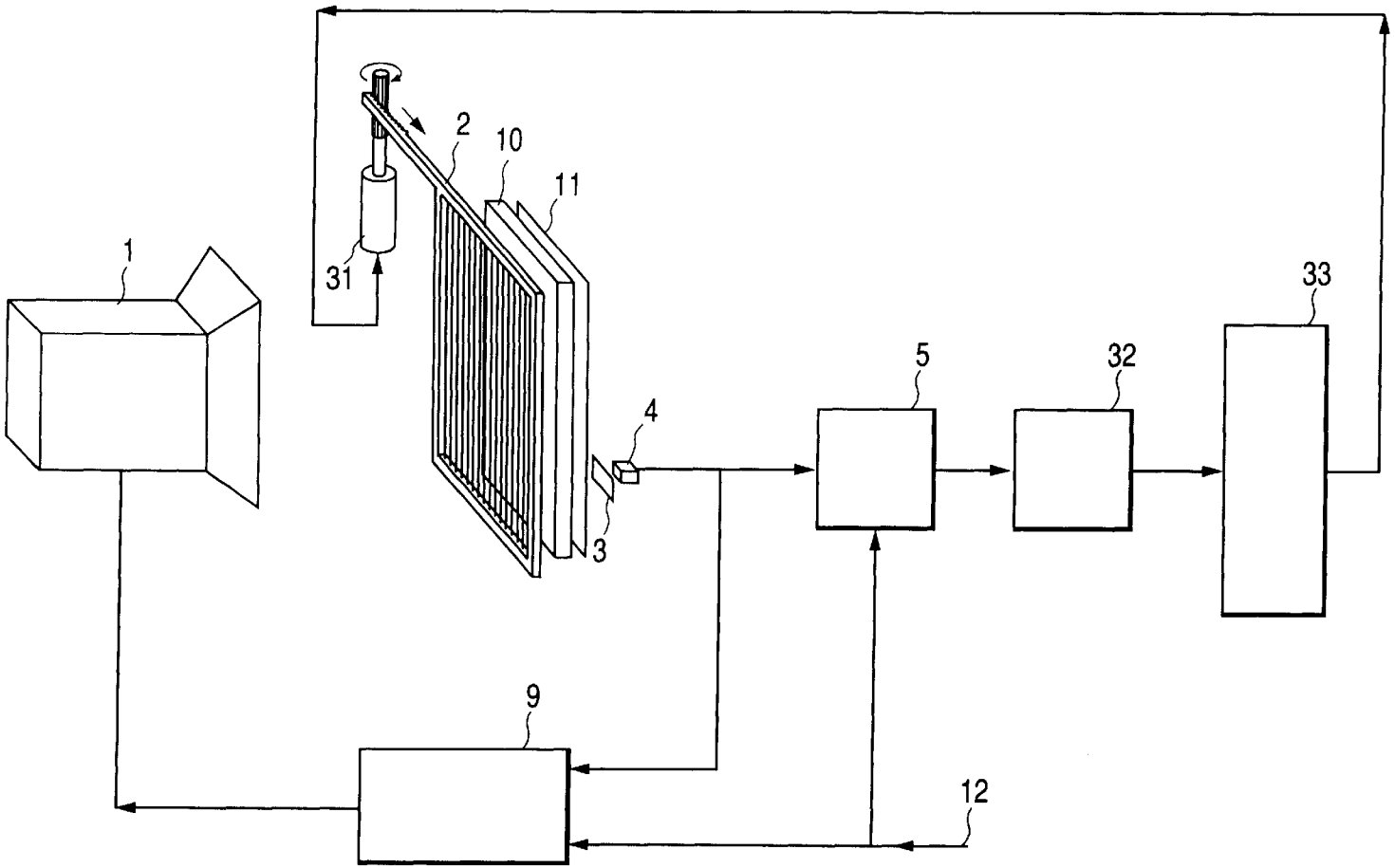

FIG. 7 is a view showing a second embodiment of the present invention, wherein the same members as those in FIG. 4 are represented by the same numbers and explanation thereof is omitted.

In FIG. 7, a stepping motor 31 drives the grid in the same manner as in the first embodiment. It is so constructed, as an example, as to move the grid by 1.25 mm which corresponds to 5 times of the grid pitch 0.25 mm, in response to a rotation by 128 pulses. An 8-bit analog digital (A/D) converter 32 converts the integrated output of the X-ray dose into a digital value, and outputs a numeral value 255 when the integrated output of the X-ray dose or the output of the amplifier 5 reaches a predetermined value. A pulse motor control device 33 is adapted to only fetch the least significant bit (LSB) of the 8-bit output of the A/D converter 32 and to convert the change of LSB into the driving pulses of the pulse motor. As the LSB varies 128 times in change of from 0 to 255, 128 pulses is provided to the pulse motor 31.

Consequently there is realized a mechanism in which the pulse motor moves the grid by 1.25 mm during the X-ray irradiation, with a moving speed proportional to the X-ray dose, so that the grid stripe pattern can be satisfactorily eliminated as in the first embodiment.

The present embodiment utilizes LSB of the output of A/D converter, but there may also be employed a comparator of which output is inverted at every predetermined range of the analog voltage.

Figure 8:
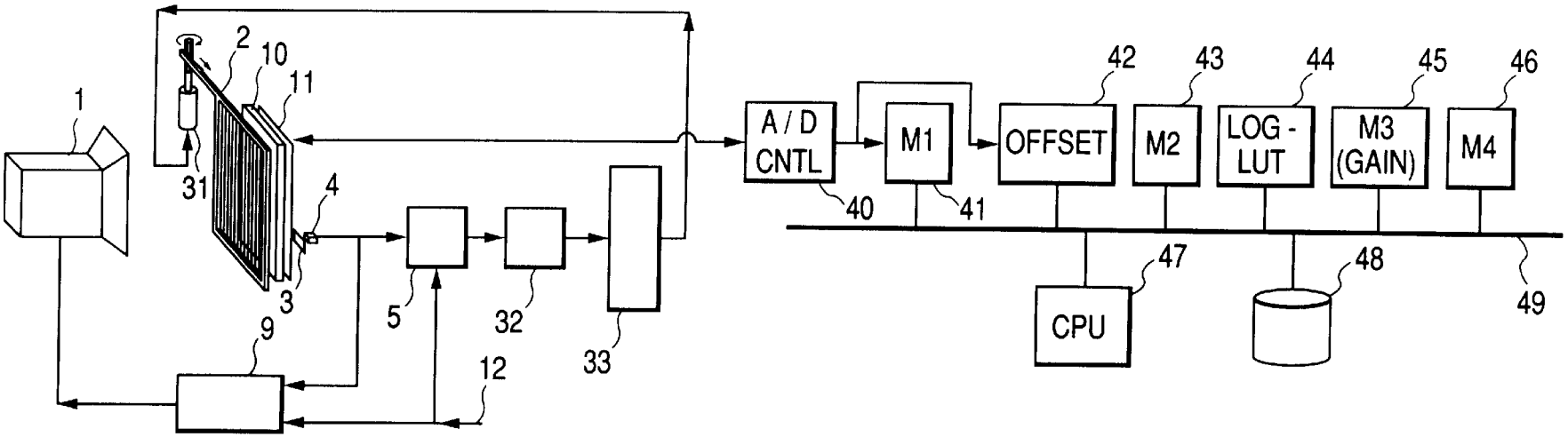

As already explained in the first embodiment, the apparatus constitution shown in FIG. 7 provides a signal flow as shown in FIG. 8.

Embodiment 3

Figure 9:
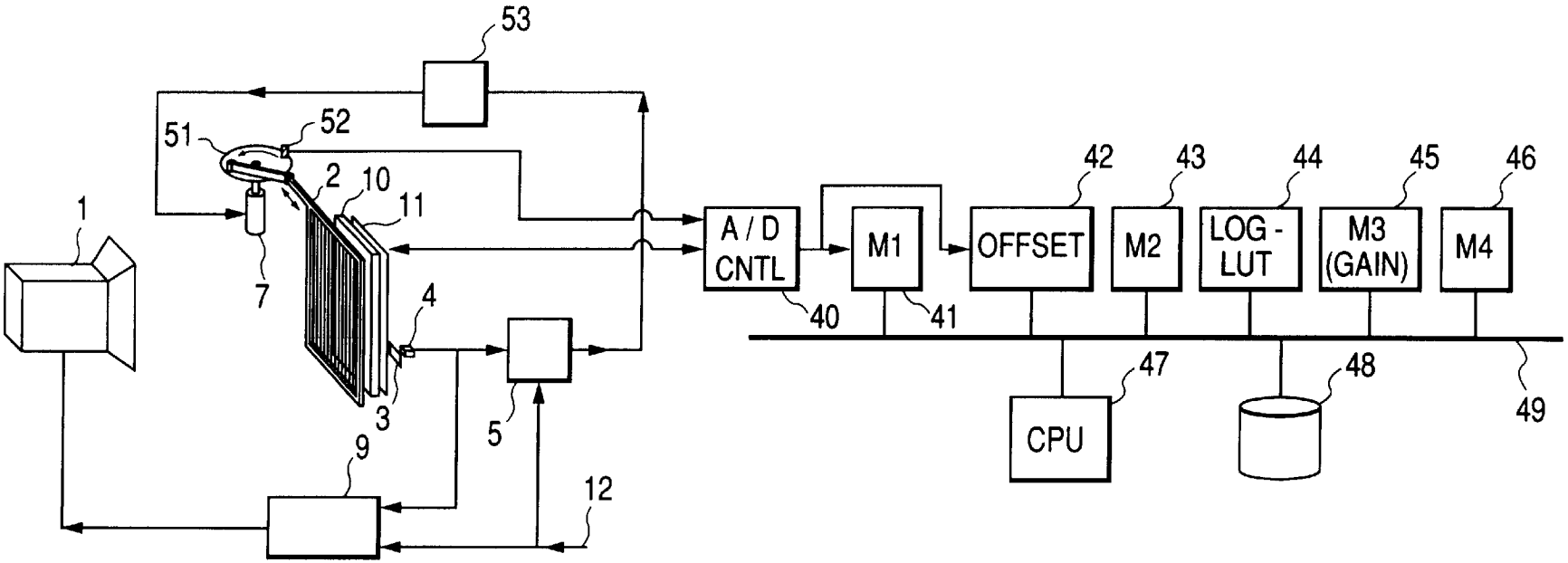

FIG. 9 shows the schematic view showing the configuration of the third embodiment of the present invention, which is different from the first embodiment in that the grid movement is achieved by a simpler motor-cam combination converting a rotary movement into a parallel displacement. In FIG. 9, a cam 51 is connected with an arm movable with the grid to convert the rotary motion of the motor 7 into a parallel displacement. A detector 52 detects the rotary position of the cam 51, and outputs a pulse when the rotary position of the cam is in a state with a relatively stable parallel moving speed (for example 10% corresponding to ±25° of the maximum speed angle position). A motor control circuit 53 for controlling the speed of the motor 7 controls the driving voltage of the motor in response to a voltage at the initial value of the integrated output voltage of the phototimer supplied from the integrating device 5.

The operation is executed in the following manner. The motor 7 is started with a suitable revolution, and the X-ray generating device 1 is activated by a control mechanism not shown in the drawing to irradiate X-ray at the moment of pulse output from the rotary position detector 7. The initial radiation dose transmitted by the inspected human body is obtained from the integrating device 5, and the revolution of the motor is instantaneously controlled accordingly. In this time, the revolution is so controlled that a predetermined amount of movement (optimally an integral multiple of the grid pitch) is reached at the X-ray cut-off timing anticipated from the X-ray dose at the start of the motor.

The grid movement is conducted, at the starting moment of X-ray irradiation, with a speed different from the target speed, but is subjected to instantaneous speed adjustment so as to finally cover the desired moving distance, thereby reducing the influence of the grid to a certain extent.

If the amount of the X-ray dose is sufficient, it is also possible to drive the image pickup device not in the initial stage of the grid speed adjustment but at the stable stage of the grid speed, thereby avoiding the grid image when the grid speed is unstable in the initial stage.

In the present invention, for the purpose of further reducing the grid stripe pattern, the grid pitch may be matched with the aperture size of the pixel.

For example, in case the pixel pitch $T_s$ is 160 $\mu$m and the light receiving face of the light receiving element in the pixel is rectangular with a width of 100 $\mu$m in the main scanning direction perpendicular to the grid, the grid pitch can be selected as 100 $\mu$m regardless of the pixel pitch, whereby the spectra of the grid ride only on the zero points of the transmission function of the apertures (namely the shadow of a grid stripe rides always on each light receiving element) and the stripes of the grid can be completely eliminated.

The size of the light receiving element is always smaller than the pixel pitch, so that the grid pitch is always smaller than the pixel pitch.

As explained in the foregoing, the present invention allows to satisfactorily eliminate the stripe pattern of the grid by correlating the moving speed of the grid with the variation of the intensity of the radiation and selecting the moving distance of the grid close to an integral multiple of the grid pitch. Besides satisfactory elimination of the stripe pattern of the grid can be achieved by acquiring the distribution of the radiation intensity with the phototimer, irrespective of the fluctuation in the inspected human body or in the inspected region thereof.

Further, the stripe pattern of the grid is eliminated preferably by selecting the grid pitch smaller than the pixel pitch and close to the aperture pitch.

The radiation in the present invention is not limited to X-ray but includes α-ray, β-ray, γ-ray and the like. Since X-ray is widely employed in the medical radiological inspections and in the non-destructive industrial inspections and the present invention is advantageously applicable to such X-ray image pickup apparatus, the present invention has been explained by the application of an X-ray image pickup apparatus.

The present invention is naturally subject to various modifications and alterations within the scope and spirit of the appended claims.

What is claimed is:

1. A radiation image pickup apparatus comprising:

radiation image pickup means for detecting radiation;

a movable grid for eliminating a scattered component of radiation entering said radiation image pickup means; and means for controlling a moving speed of said movable grid corresponding to variation of an intensity of the radiation, based on an output from an encoder associated with a motor used for moving said movable grid.

2. The radiation image pickup apparatus according to claim 1, further comprising a phototimer for detecting the intensity of the radiation.

3. The radiation image pickup apparatus according to claim 2, wherein said phototimer is provided in a position for detecting the radiation transmitted by said radiation image pickup means.

4. The radiation image pickup apparatus according to claim 2, further comprising calculation means for integrating an output of said phototimer.

5. The radiation image pickup apparatus according to claim 1, wherein a pitch of said movable grid is smaller than a pitch of a pixel of said radiation image pickup means.

6. The radiation image pickup apparatus according to claim 5, wherein said pitch of the movable grid is substantially equal to a width of a light receiving portion of the pixel in the same direction as that of the pitch, or substantially equal to a value obtained by dividing the width of the light receiving portion with a positive integer.

7. The radiation image pickup apparatus according to claim 1, further comprising means for memorizing a radiation distribution obtained by moving said movable grid in the absence of an inspected object.

8. The radiation image pickup apparatus according to claim 7, further comprising means for correcting a radiation distribution obtained in the presence of the inspected object, based on the radiation distribution, obtained in the absence of the inspected object.

9. The radiation image pickup apparatus according to claim 1, wherein said radiation image pickup means comprises photoelectric converting devices arranged in a matrix pattern.

10. The radiation image pickup apparatus according to claim 1, wherein said radiation image pickup means comprises a wavelength converting member for converting a wavelength of the incident radiation.

11. A method of driving a radiation image pickup apparatus, comprising the steps of:

providing a movable grid for eliminating a scattered component of radiation entering the radiation image pickup apparatus;

moving the grid with a motor, the motor including an encoder;

detecting variation of an intensity of the radiation entering the radiation image pickup apparatus;

controlling a moving speed or a moving position of the grid corresponding to the detected variation of the intensity and based on an output from the encoder, in order to eliminate the scattered component of the radiation entering the radiation image pickup apparatus.

12. A method of driving a radiation image pickup apparatus, comprising the steps of:

providing a movable grid for eliminating a scattered component of a radiation entering the radiation image pickup apparatus;

controlling a moving speed or a moving position of the grid corresponding to a variation of intensity of the radiation in order to eliminate the scattered component of the radiation entering the radiation image pickup apparatus; and moving the grid to a position corresponding to an integrated value of the intensity of the radiation.

13. The method according to claim 11, wherein the intensity of the radiation is obtained by utilizing variation of the intensity of the radiation detected by a phototimer.

14. The method according to claim 11, wherein a final moving distance of the grid is selected substantially equal to an integral multiple of a pitch of the grid.

15. The method according to claim 11, further comprising a step of acquiring an intensity distribution of the radiation by moving the grid in the absence of an inspected object.

16. The method according to claim 15, further comprising a step of correcting, an intensity distribution of the radiation obtained in the presence of the inspected object, based on the intensity distribution of the radiation in the absence of the inspected object.

17. The method according to claim 11, wherein irradiation with the radiation is started when the grid reaches a sufficient speed under speed control.

18. The method according to claim 11, wherein the radiation image pickup apparatus comprises an image pickup device, and the driving timing of the image pickup device is conducted when the grid reaches a sufficient speed under speed control.

19. A method of driving a radiation image pickup apparatus, comprising a steps of:

providing a movable grid for eliminating a scattered component of a radiation entering the radiation image pickup apparatus;

controlling a moving speed or a moving position of the grid corresponding to a variation of intensity of the radiation in order to eliminate the scattered component of the radiation entering the radiation image pickup apparatus; and correcting data obtained in the presence of the radiation by utilizing data obtained from the radiation image pickup apparatus in the absence of the radiation.

20. The method according to claim 11, wherein the radiation image pickup apparatus comprises a plurality of photoelectric converting devices arranged in a matrix pattern, and the photoelectric converting devices execute photoelectric conversion according to information obtained by wavelength conversion of a wavelength converting member.

21. The method according to claim 12, wherein the intensity of the radiation is obtained by utilizing variation of the intensity of the radiation detected by a phototimer.

22. The method according to claim 12, wherein a final moving distance of the grid is selected substantially equal to an integral multiple of a pitch of the grid.

23. The method according to claim 12, further comprising a step of acquiring an intensity distribution of the radiation by moving the grid in the absence of an inspected object.

24. The method according to claim 23, further comprising a step of correcting, an intensity distribution of the radiation obtained in the presence of the inspected object, based on the intensity distribution of the radiation in the absence of the inspected object.

25. The method according to claim 12, wherein irradiation with the radiation is started when the grid reaches a sufficient speed under speed control.

26. The method according to claim 12, wherein the radiation image pickup apparatus comprises an image pickup device, and the driving timing of the image pickup device is conducted when the grid reaches a sufficient speed under speed control.

27. The method according to claim 12, further comprising a step of correcting data obtained in the presence of the radiation image pickup apparatus in the absence of the radiation.

28. The method according to claim 12, wherein the radiation image pickup apparatus comprises a plurality of photoelectric converting devices arranged in a matrix pattern, and the photoelectric converting devices execute photoelectric conversion according to information obtained by wavelength conversion of a wavelength converting member.

29. The method according to claim 19, wherein the intensity of the radiation is obtained by utilizing variation of the intensity of the radiation detected by a phototimer.

30. The method according to claim 19, wherein a final moving distance of the grid is selected substantially equal to an integral multiple of a pitch of the grid.

31. The method according to claim 19, further comprising a step of acquiring an intensity distribution of the radiation by moving the grid in the absence of an inspected object.

32. The method according to claim 31, further comprising a step of correcting, an intensity distribution of the radiation obtained in the presence of the inspected object, based on the intensity distribution of the radiation in the absence of the inspected object.

33. The method according to claim 19, wherein irradiation with the radiation is started when the grid reaches a sufficient speed under speed control.

34. The method according to claim 19, wherein the radiation image pickup apparatus comprises an image pickup device, and the driving timing of the image pickup device is conducted when the grid reaches a sufficient speed under speed control.

35. The method according to claim 19, wherein the radiation image pickup apparatus comprises a plurality of photoelectric converting devices arranged in a matrix pattern, and the photoelectric converting devices execute photoelectric conversion according to information obtained by wavelength conversion of a wavelength converting member.

36. A method of driving a radiation image pickup apparatus, comprising the steps of:

providing a movable grid for eliminating a scattered component of radiation entering the radiation image pickup apparatus;

moving the grid with a motor;

detecting variation of an intensity of the radiation entering the radiation image pickup apparatus;

controlling a moving speed or a moving position of the grid corresponding to the detected variation of the intensity by controlling a pulse inputted to the motor, in order to eliminate the scattered component of the radiation entering the radiation image pickup apparatus.

37. The method according to claim 36, wherein the grid is moved to a position corresponding to an integrated value of the intensity of the radiation.

38. The method according to claim 36, wherein the intensity of the radiation is obtained by utilizing variation of the intensity of the radiation detected by a phototimer.

39. The method according to claim 36, wherein a final moving distance of the grid is selected substantially equal to an integral multiple of a pitch of the grid.

40. The method according to claim 36, further comprising a step of acquiring an intensity distribution of the radiation by moving the grid in the absence of an inspected object.

41. The method according to claim 40, further comprising a step of correcting, an intensity distribution of the radiation obtained in the presence of the inspected object, based on the intensity distribution of the radiation in the absence of the inspected object.

42. The method according to claim 36, wherein irradiation with the radiation is started when the grid reaches a sufficient speed under speed control.

43. The method according to claim 36, wherein the radiation image pickup apparatus comprises an image pickup device, and the driving timing of the image pickup device is conducted when the grid reaches a sufficient speed under speed control.

44. The method according to claim 36, further comprising a step of correcting data obtained in the presence of the radiation by utilizing data obtained from the radiation image pickup apparatus in the absence of the radiation.

45. The method according to claim 36, wherein the radiation image pickup apparatus comprises a plurality of photoelectric converting devices arranged in a matrix pattern, and the photoelectric converting devices execute photoelectric conversion according to information obtained by wavelength conversion of a wavelength converting member.

46. A radiation image pickup apparatus comprising:

radiation image pickup means for detecting radiation;

a movable grid for eliminating a scattered component of radiation entering said radiation image pickup means;

a motor for moving said movable grid;

means for regulating a driving amount of said motor, said regulating means including one of an encoder, a cam, and an input device for a pulse motor;

means for monitoring a radiation amount radiated to said radiation image pickup means; and means for controlling a moving speed of said movable grid based on an initial amount of the radiation detected by said monitoring means.

47. A radiation image pickup apparatus according to claim 46, wherein said monitoring means comprises a phototimer.

48. A radiation image pickup apparatus according to claim 46, wherein said monitoring means comprises a phototimer, and wherein said phototimer is provided at a position where radiation permeated through said radiation image pickup means can be detected.

49. A radiation image pickup apparatus according to claim 46, wherein a pitch of said movable grid is smaller than a pixel pitch of said radiation image pickup means.

50. A radiation image pickup apparatus according to claim 46, wherein said radiation image pickup means has photoelectric converting devices arranged in a matrix.

51. A radiation image pickup apparatus according to claim 46, wherein said radiation image pickup means has a wavelength converting member for converting a wavelength of the radiation.

52. A method of driving a radiation image pickup apparatus, comprising the steps of:

providing a movable grid for eliminating a scattered component of radiation entering the radiation image pickup apparatus;

moving the grid with a motor, the motor including an encoder;

controlling a moving speed of the movable grid by controlling moving means used for moving the movable grid, in order to eliminate the scattered component of the radiation entering the radiation image pickup apparatus corresponding to an initial amount of radiation entering the radiation image pickup apparatus.

53. A method of driving a radiation image pickup apparatus according to claim 52, further comprising the step of monitoring an amount of the radiation to obtain the initial amount of the radiation.

54. A method of driving a radiation image pickup apparatus according to claim 52, further comprising the step of monitoring an amount of the radiation to obtain the initial amount of the radiation, and wherein when the initial amount of the radiation is maintained and an amount of the radiation reaches a suitable amount of the radiation, the movable grid is moved such that a moving distance of the movable grid is an integral multiple of a grid pitch.

* * * * *

UNITED STATES PATENT AND TRADEMARK OFFICE

CERTIFICATE OF CORRECTION

PATENT NO. : 6,167,115
DATED : December 26, 2000
INVENTOR(S) : Hitoshi Inoue

It is certified that error appears in the above-identified patent and that said Letters Patent is hereby corrected as shown below:

Column 2,
Line 32, "|S (f) | |L (f) xsin (IImf$T_g$) / (IImf$T_g$)" should read -- |S (f) | ∝|L (f) xsin (IImf$T_g$) / (IImf$T_g$) --.

Column 3,
Line 51, "Ts" should read -- $T_s$ --.

Column 5,
Line 39, "agraph" should read -- graph --.

Column 7
Line 35, "is" should read -- is 125 μm --.

Signed and Sealed this

Eighth Day of January, 2002

*Attest:*

Nicholas P. Godici

*Attesting Officer*

NICHOLAS P. GODICI
*Acting Director of the United States Patent and Trademark Office*